United States Patent [19]

Welty

[11] 4,011,022

[45] Mar. 8, 1977

[54] SELF-DRAINING VEHICULAR SUPPORTING PANEL AND STRUCTURE

[76] Inventor: Lloyd G. Welty, 410 S. Beverly Drive, Beverly Hills, Calif. 90212

[22] Filed: Dec. 3, 1975

[21] Appl. No.: 637,201

[52] U.S. Cl. ..... 404/40; 52/505

[51] Int. Cl.[2] ..... E01C 5/22

[58] Field of Search ..... 404/41, 44, 27, 40, 404/21, 4, 17, 43, 28; 137/234.6, 236; 52/303, 505

[56] References Cited

UNITED STATES PATENTS

| | | | |
|---|---|---|---|
| 323,086 | 7/1885 | Thornton | 404/4 |
| 340,153 | 4/1886 | Pimm | 404/4 |
| 1,934,782 | 11/1933 | Adams | 404/4 |
| 2,174,035 | 9/1939 | Henderson | 404/4 |
| 2,515,847 | 7/1950 | Winkler | 404/35 X |
| 2,956,652 | 10/1960 | Liskey | 404/43 X |
| 3,174,411 | 3/1965 | Oestrich | 404/17 |
| 3,175,476 | 3/1965 | Franks | 404/35 |
| 3,181,440 | 5/1965 | Mullaney | 404/21 X |
| 3,272,096 | 9/1966 | Lum | 404/1 |

*Primary Examiner*—Nile C. Byers
*Attorney, Agent, or Firm*—Harris, Kern, Wallen & Tinsley

[57] ABSTRACT

A frictional self-draining structure for a vehicular supporting surface, comprised of a plurality of prefabricated interlocking panels, each panel including a relatively flat upper surface to which is attached a layer of structurally rigid porous aggregate, each panel having a plurality of parallel longitudinal fluid conduits therethrough beneath its upper surface and perforations communicating between the upper surface and the conduits.

9 Claims, 8 Drawing Figures

SELF-DRAINING VEHICULAR SUPPORTING PANEL AND STRUCTURE

BACKGROUND OF THE INVENTION

The present invention relates to the field of structural surfaces for vehicular supporting pavements and the like, particularly airport runways, automotive raceways and pavements.

The collection of water, snow, and ice on such pavements has long been an acute problem, causing skidding and hydroplaning of high-speed automotive vehicular traffic thereon. Various attempts have been made, at best only partially successful, to correct or ease such problem.

One such attempt has been to longitudinally score the top surface of concrete pavements with a plurality of substantially parallel shallow grooves. This has somewhat reduced the skidding hazard but does not eliminate it because it does not get rid of water, snow, or ice collecting on the pavement, and skidding or hydroplaning thereon remains a hazard.

Another such attempt has been to provide an upper nonporous surface for such pavements having a high coefficient of friction, formed of an aggregate of particles of scoria or slag, bound together by a resinous binder [See: patents to Welty et al, U.S. Pat. No. 2,925,831 and U.S. Pat. No. 3,396,641]. Such pavements reduce the skidding hazard but do not eliminate it because they are nonporous and do not get rid of water, ice, or snow collecting thereon.

Another such attempt has been to provide such a pavement with an upper surface formed of a porous aggregate of particles of scoria, or slag, only partially bonded together with a resinous binder to leave generally vertical channels or canals therethrough for the passage of water [See: Welty U.S. Pat. No. 3,690,227]. This construction reduces the amount of water collecting on the upper surface of the pavement and reduces vehicular skidding or hydroplaning. However, due to the usually large area of such pavements and the small size and great length of the channels or canals through the porous aggregate, the passage of water therethrough is relatively slow. Another, and more serious disadvantage of this last pavement is that the porous aggregate surface must be laid and formed on the job site over acres of area by commonly unskilled workmen and requires the transport to the job site of tons of raw material.

For aircraft runway surfaces various types of portable mattings have been developed. Several of such types are described in the patent to Clayton et al, U.S. Pat. No. 3,301,157 which shows and describes a modular type of such matting in which the matting is formed of modular units which can be prefabricated, transported to the runway site, and are laid by interlocking them together. This latter type of runway matting is nonporous and water, snow, and ice can collect thereon as with any conventional roadway surface, with the attendant disadvantages, some of which are pointed out above.

SUMMARY OF INVENTION

The present invention is directed to a frictional self-draining surface for surfacing a vehicular supporting surface, comprised of a plurality of prefabricated and interlocking panels, each panel including a relatively flat upper surface to which is attached a layer of structurally rigid porous aggregate, each panel having a plurality of parallel longitudinal fluid conduits therethrough beneath its upper surface and having perforations communicating between the upper surface and the conduits.

An object of the structure of the present invention is to provide such panels which can be readily transported to the desired site for installation and which can be readily installed to form the structure and can be separately and easily removed for repair or replacement.

Another object of the invention is to provide such a structure in which the panels are interlocked together against lateral and longitudinal separation.

Still another object of the invention is to provide such a structure in which water can drain quickly from the upper surface only a short distance into large fluid channels below such layer which convey the runoff to one or more collection or disposal points. It is also an object of the invention to provide such a structure in which a heating fluid can be pumped through such channels, and through the porous aggregate layer to heat the same, countercurrent to and simultaneously with or independent of the flow of water through such channels, to assist in melting snow or ice on the upper surface of the aggregate layer.

A further object of the invention is to make such panels of a metal having a high coefficient of heat conductivity, such as an aluminum alloy, which will transfer heat by conduction from their inner channels conveying a heated fluid to the surface layer of aggregate and thereby contribute to the quick melting of snow or ice collecting thereon.

Another object of the invention is to provide such panels at each end with end plates which have interlocking means for connecting one end of one panel to an end of an adjoining panel, in which there is a perforation in each plate communicating with a similar perforation in an adjacent end plate to permit fluid to flow from one panel to its adjoining panel through such aligned perforations, such perforations being below such interlocking means.

Other features and objects of the invention will appear hereinafter.

THE DRAWINGS

Referring to the drawings.

DESCRIPTION OF PREFERRED EMBODIMENT

Figure 1:
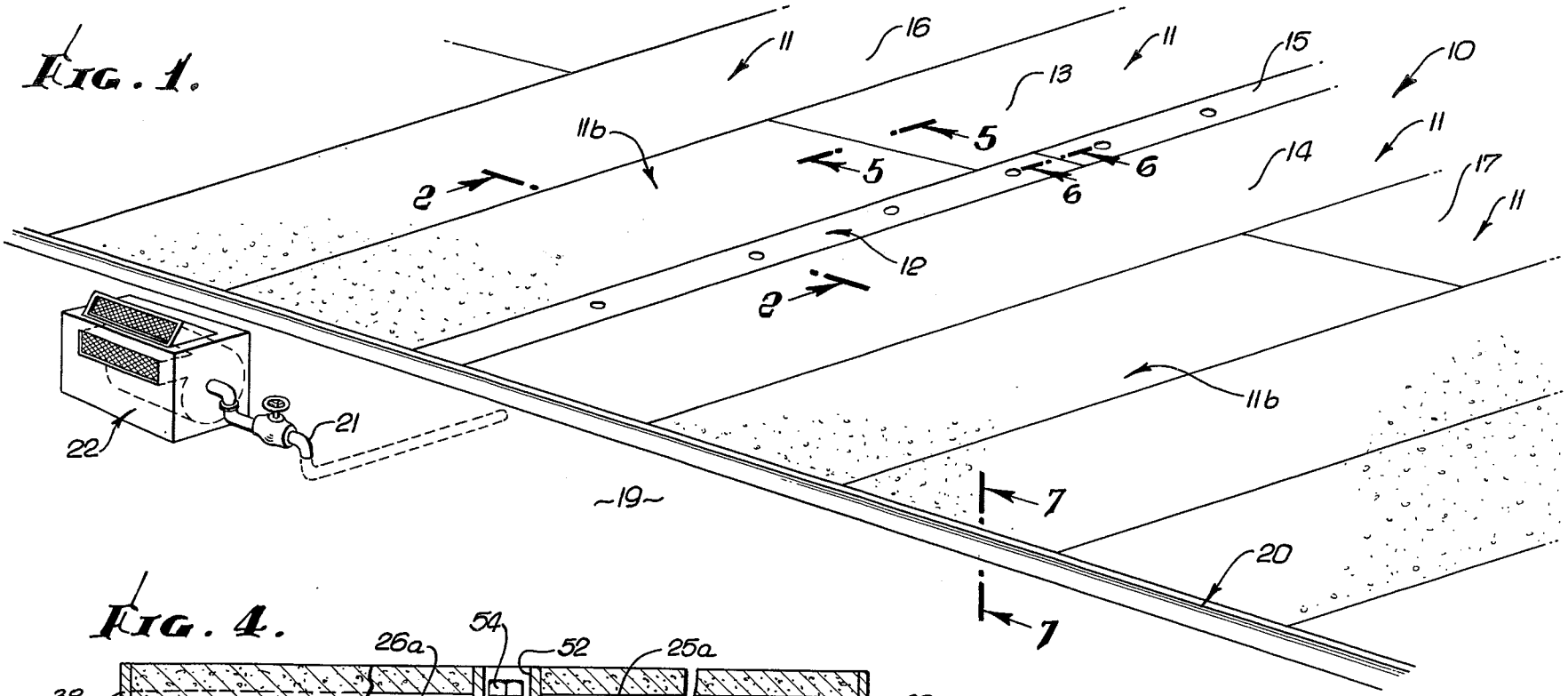
FIG. 1 is a fragmentary perspective view of a portion of an airport runway embodying the invention.
Figure 4:
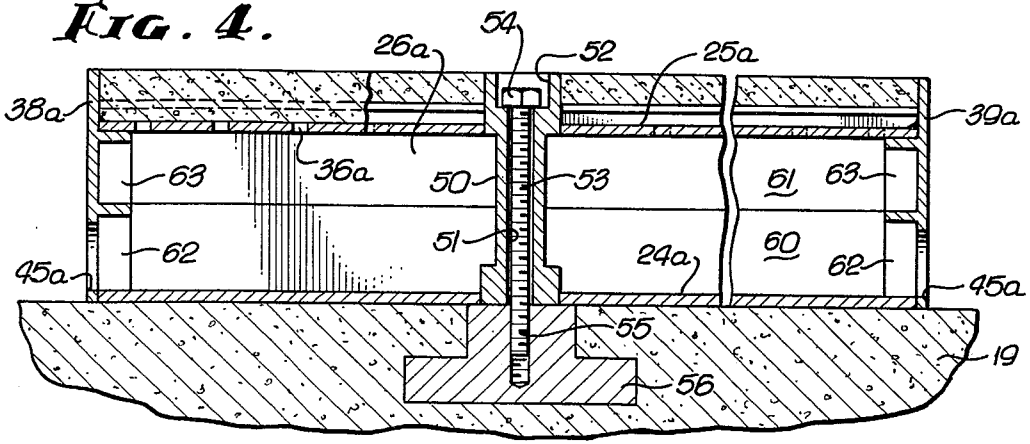
FIG. 4 is a longitudinal sectional view taken on the line 4—4 of FIG. 2.

Referring to the drawings, FIG. 1 shows a section of frictional self-draining structure 10 including wide longitudinal panels 11 and narrow panels 12, rows 13 and 14 of wide panels 11 flanking a row 15 of narrow panels 12, the rows 13 and 14 of wide panels being flanked by similar rows of wide panels 16 and 17, respectively.

Figure 7:
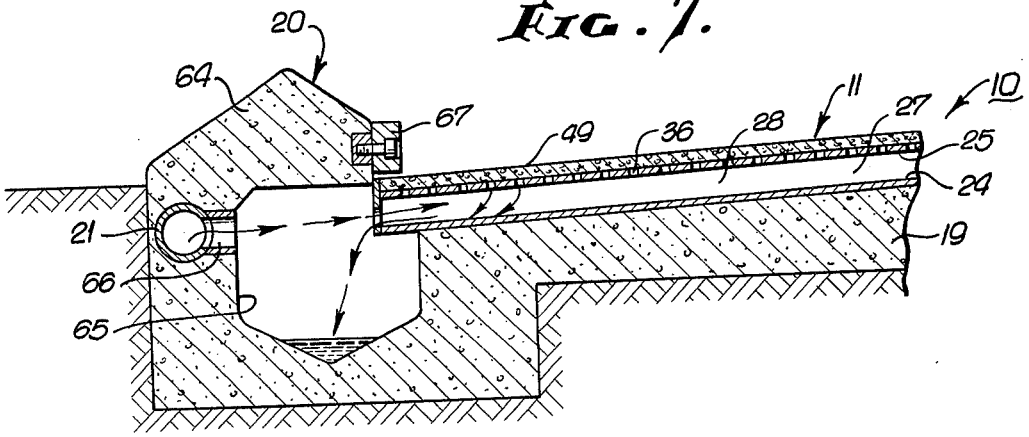
FIG. 7 is a sectional view taken on the line 7—7 of FIG. 1.

The structure 10 is preferably laid on a substrata base 19, formed of concrete or other suitable material, preferably sloping from one longitudinal edge to the other on a gradient suitable for liquid drainage, such as about 1.5 degrees, also illustrated in FIG. 7. Along the thin edge of the base 19 extends a conduit means 20 to which is connected by piping 21 a blower means 22. Although for simplicity of illustration the substrata base 19 is shown as sloping from one longitudinal edge to the other, it is to be understood that where the self-draining structure 10 is to be used for a relatively wide aircraft runway the high point of the base may be at its center line with the base sloping away in each lateral direction from such center line to provide liquid drainage laterally in both directions from the center line, as will appear more fully hereinafter.

Referring particularly to FIG. 1, each of the wide panels 11 is preferably rectangular in plan, and a convenient dimensional relationship is that each panel be about 2 × 10 and 2 to 4 inches thick, although a few of such wide panels must be provided in half lengths 11*b* to permit the panels in adjoining rows to be staggered, as described hereinafter. Each of the panels 11, 11*b*, and 12 is preferably formed of a heat conductive metal, such as an aluminum alloy, which is light in weight.

Each of the wide panels 11 has a base plate 24, a top plate 25, a pair of spaced side plates 26 connecting the top and base plates, and a plurality of spaced longitudinal ribs 27 also connecting the top and base plates and the spaces between such ribs forming longitudinal channels 28. Each of the ribs 27 is provided at each end with a notch 29. Each of the side plates 26 on a panel 11 is provided with connecting means consisting of generally parallel and depending longitudinally dogs 31 on one of such side plates and generally parallel and upwardly extending longitudinal dogs 32 on the other side plate. Each of the side plates 26 has a rim portion 33 projecting above the top surface 34 of the top plate 25. The top plate 25 is preferably provided with a plurality of upwardly and longitudinally extending spaced rails 35, between which are a plurality of perforations 36 extending through the top plate and communicating with the longitudinal channels 28. Such portions of each wide panel 11 is preferably formed of an aluminum alloy as a one-piece extrusion by any method well known in the art.

Figure 3:
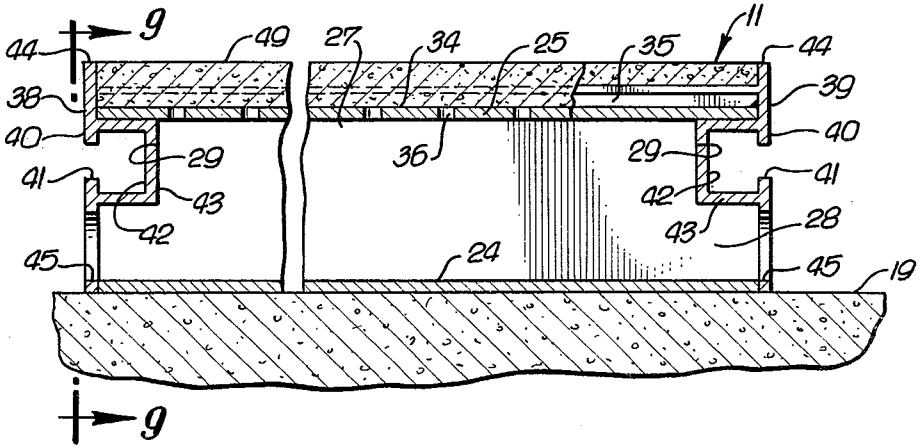
FIG. 3 is a longitudinal sectional view taken on the line 3—3 of FIG. 2.
Figure 5:
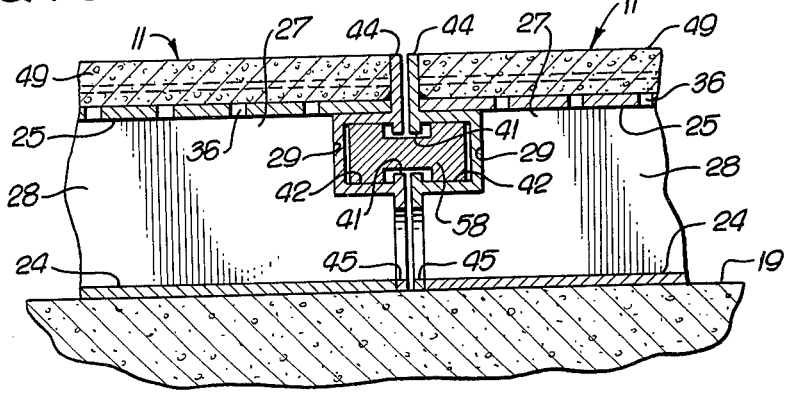
FIG. 5 is a sectional view taken on the line 5—5 of FIG. 1.
Figure 6:
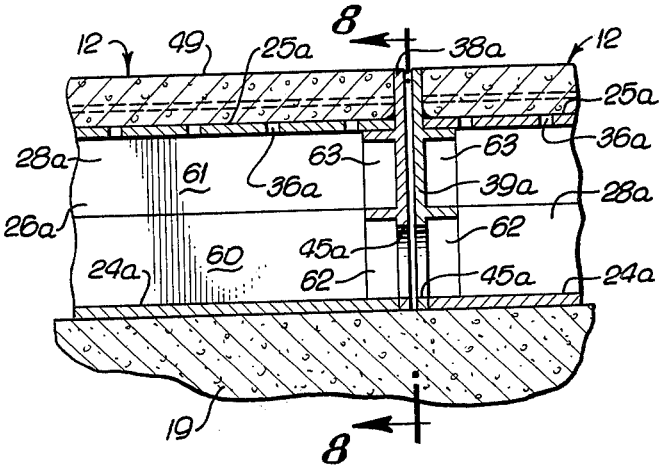
FIG. 6 is a sectional view taken on the line 6—6 of FIG. 1.
Figure 8:
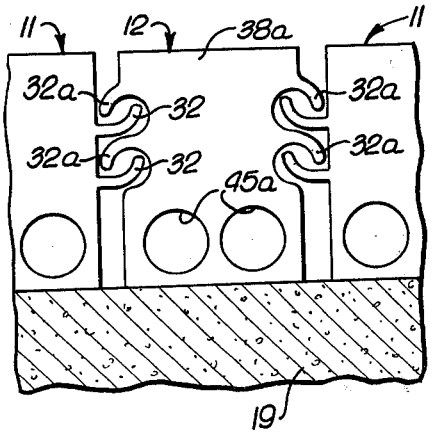
FIG. 8 is an end view of one of the end plates of the invention taken on the line 8—8 of FIG. 6.

Each of the wide panels 11 also has a pair of end plates 38 and 39, one at each end of the panel and rigidly secured thereto, as by welding. Each of the end plates 38 and 39 has a face plate 40 provided with a narrow longitudinal slot 41 communicating with a wider keyway 42 formed by a longitudinally extending hollow boss 43, generally rectangular in cross-section, which fits snugly into the notches 29 of the ribs 27. When assembled in the remainder of the wide panel 11, as shown in FIGS. 3 and 5, the upper portion of the face plate 40 provides a rim 44 which extends upwardly above the top plate 25 the same distance as the rims 33 on the side plates 26. The lower portion of the face plate 40 is provided with perforations 45, each of which communicates with a longitudinal channel 28.

Figure 9:
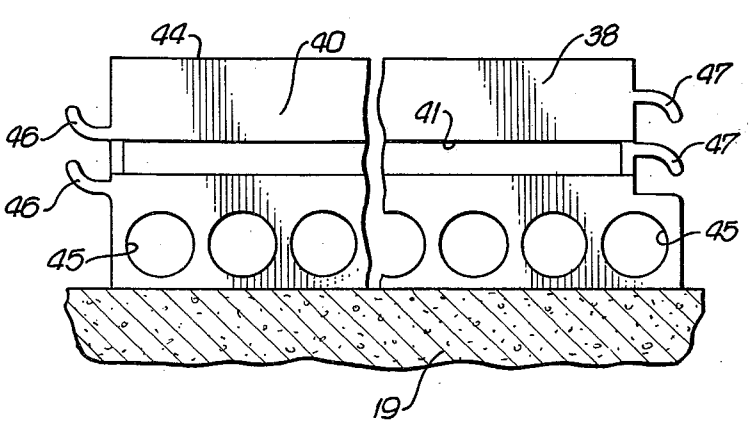
FIG. 9 is an end view of another end plate of the invention taken on the line 9—9 of FIG. 3.

The end plate 38 has, at its left end as seen in FIG. 9, a pair of upwardly extending dogs 46 which register with the dogs 32 on the mating side plate 26, and at its right end a pair of dogs 47 which register with the dogs 31 on the adjacent side plate 26. The end plate 39 is identical with the end plate 38 except that the pair of upwardly extending dogs 46 are provided on the right-hand end of the end plate instead of the left-hand end as in the plate 38, and the dogs 47 are located on the left-hand end of the plate instead of the right-hand end as in plate 38. In other words, the end plates 38 and 39 are made in a "right" and a "left", one to match the side plates on one end of the panel and the other to match the side plates on the other end of the panel. The end plates 38 and 39 are preferably formed as extrusions of an aluminum alloy and are rigidly secured to the remaining metal portion of the panel, as by welding.

Each of the wide panels 11 is also provided with a layer means 49 confined between the rims 33 and 44 and extending upwardly from the top surface 34 the same distance as such rims so as to be horizontally level therewith. The layer means 49 is preferably formed of a mixtue of aggregate particles of about two to four volumes of scoria and/or slag particles and one part by volume of a settable resinous binder or other porous layers of such particles as described in my U.S. Pat. No. 3,690,227, referred to above. Such mixture is troweled or otherwise applied to the top surface 34 of the panel 11 between the rims 33 and 34, level with the tops thereof and around the rails 35. The resinous binder bonds the particles of scoria and/or slag together and to the engaged metal parts of the panel to form a rigid porous aggregate providing a multiplicity of open channels through the layer means 49 and communicating with the perforations 36. The exposed surface of such layer means 49 has a high coefficient of friction, greatly reducing the skidding of vehicle tires thereon. Such open channels and the frictional characteristics of the layer means 49 are described and illustrated in my said U.S. Pat. No. 3,690,227.

Figure 2:
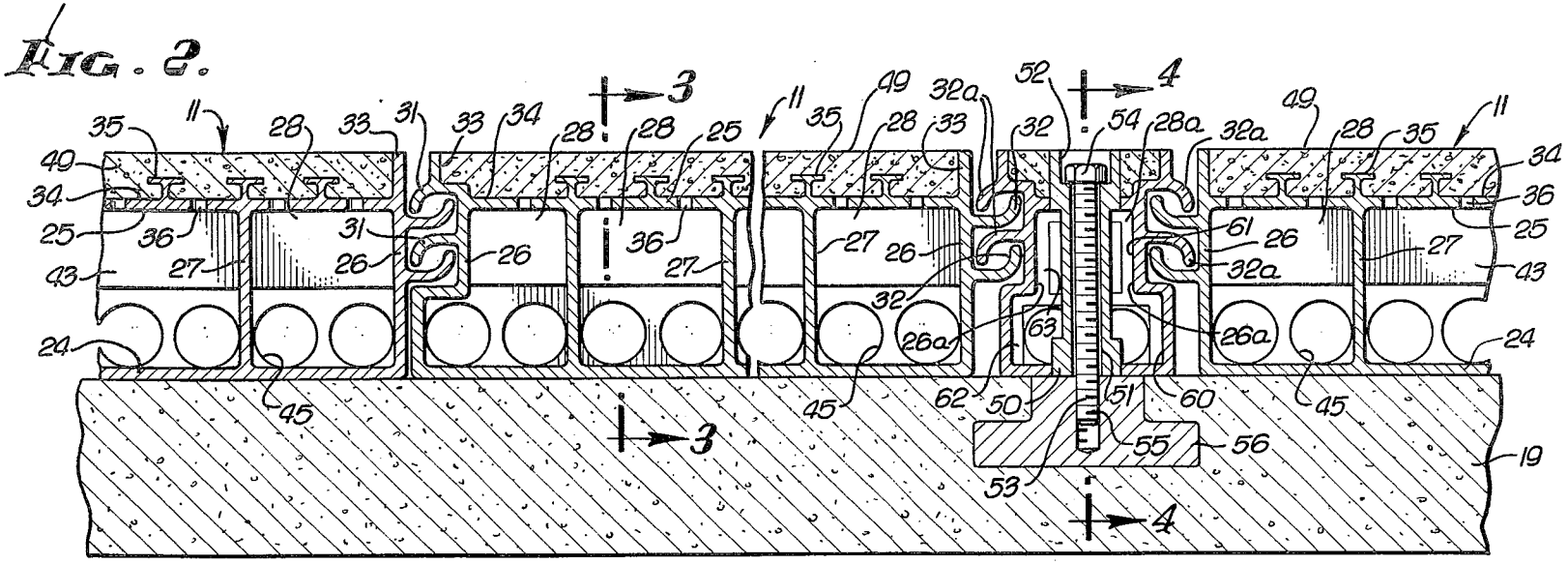
FIG. 2 is a vertical section taken on the line 2—2 of FIG. 1.

Each of the narrow panels 12 is generally similar to the wide panels 11, and similar parts are given similar reference numerals with the suffix *a* added. The respects in which the narrow panels 12 differ from the wide panels 11 are pointed out as follows. Each narrow panel 12 has a pair of longitudinal dogs 32*a* along each side plate 26*a* thereof, but all of such dogs 32*a* are preferably turned downwardly as illustrated. In the narrow panel 12 the longitudinal ribs 27 of the side panels 11 are omitted because they are not needed to provide compresssive strength to the narrow panels, so that each narrow panel as only a single longitudinal channel 28*a*. Since the dogs 32*a* of the narrow panel 12 all turn downwardly its end plates 38*a* and 39*a* may be identical and interchangeable. As shown in FIG. 2, the longitudinal channel 28*a* is formed to provide a wide portion 60 and a relatively narrow portion 61 to receive projections 62 and 63, respectively, on the inner face of each end plate 38*a* and 39*a*, to properly align each end plate with the narrow panel 12 to which it is rigidly attached, as by welding.

Each of the narrow panels 12 includes a tie-down means for connecting it to the substrate base 19, preferably consisting of a sleeve 50 extending through suitable holes in the base plate 24*a* and top plate 25*a* and welded to such plates, the sleeve having a longitudinal bore 51 and a counterbore 52 through which extends a bolt 53 having a head 54 received in the counterbore, the lower end of the bolt being threaded at 55 to extend into a tie plate 56 cast in or otherwise rigidly secured to the upper surface of the substrata base 19. Each of the narrow panels 12 preferably has two or more of such tie down means spaced along its length.

The wide panels 11 are adapted to be connected together end to end, as illustrated in FIG. 5, by a key 58 which fits in the keyways 42 of abutting panels, as shown in FIG. 5. Each key 58 is preferably shorter in length than the width of the wide panels 11 so as not to interfere with the interlocking of the longitudinal edges of the panels.

As illustrated in FIG. 7, the conduit means 20 includes a manifold block 64 formed along an outer edge of the substrata base 19, having a longitudinal duct 65 adapted to communicate with the longitudinal channels 28 and 28*a* of the panels 11, 11*b*, and 12 to receive liquid drainage therefrom and lead it to a point of disposal (not shown). The piping 21 extends longitudinally through the manifold block 64 and is provided with openings 66 spaced therealong and communicating with the duct 65. A hold-down bar 67 is bolted or otherwise secured to the manifold block 64 above the ends of the panels to hold the same down after they are placed in position, as described hereinafter.

In constructing the frictional self-draining structure 10 of the invention, for use as an airport runway as an example, the substrata base 19 is first made by conventional methods with a width substantially a multiple of the length of the panels 11 and 12, e.g., 100 or 200 feet, with the conduit means 20 along the thin longitudinal edge of the base, and a desired length, for example 2000 to 4000 feet. A transverse row of tie plates 56 is cast in or otherwise secured to the substrata base 19, the tie plates being at appropriate intervals to receive the bolts 53 of the narrow panels 12. The row 15 of the narrow panels 12 is then laid end to end across the substrata base 19, and each of such panels is rigidly mounted on the base by threading the bolts 53 into matching tie plates 56. Since the narrow panels are in longitudinal alignment, the perforations 45*a* in the end plates 38*a* and 39*a* of adjoining narrow panels are aligned with each other and the longitudinal channels 28*a* thereof communicate with each other and with the duct 65 of the conduit means 20, to permit fluid to flow in both directions therethrough.

A row 14 of wide panels 11 is then sequentially laid alongside of the row 15 of narrow panels, preferably starting at the conduit means side of the substrata base 19. A first wide panel 11 is then interlocked with the first narrow panel 12 by tilting the wide panel laterally and passing its upwardly extending dogs 32 under the downwardly extending dogs 32*a* of the narrow panel and then lowering the wide panel to a horizontal position in which its dogs 32 interlock with the dogs 32*a* of the narrow panel. Such interlock is loose, permitting some articulation between the interconnected panels but preventing their lateral separation. A second wide panel 11 is then similarly connected to the first narrow panel 12 or the next narrow panel in alignment therewith and is slipped towards the first laid wide panel until their adjacent end plates almost engage each other, following which a key 58 is slipped into the adjoining keyways 42 of such panels, to the position shown in FIG. 5, which loosely interlocks such wide panels end to end so as to permit slight longitudinal articulation therebetween but preventing longitudinal separation thereof. The row 14 of wide panels 11 is then completed by laying additional wide panels end to end and interlocked as described above.

A second row 17 of wide panels is then laid alongside of and interlocked with the first row 14 and with each other. Since the exposed longitudinal dogs 31 of the first row 14 of wide panels 11 depend downwardly, the second row 17 is laid so that the upwardly projecting dogs 32 of its wide panels 11 interlock with such downwardly extending dogs of the first row, as described above as to the interconnection of the first row 14 with the row 15 of narrow panels 12. To provide an overlap of the panels 11 in adjoining rows, as illustrated in FIG. 1, the second row 17 is started and finished with a half-length wide panel 11*b*.

Additional rows of wide panels 11 and 11b are laid beside those already laid on each side of the row 15 of narrow panels 12 to cover a desired area. Preferably, in forming large areas of the self-draining structure 10, additional rows of narrow panels 12 are laid parallel to the row 15 at intervals of preferably not more than 100 feet and similarly connected to adjoining rows of wide panels, to insure that the entire structure is securely fastened to the substrata base 19.

As described in my U.S. Pat. No. 3,690,227, water or other liquid falling on the upper surface of the porous layer means 49 readily passes downwardly through the channels therein. The porosity of such layer means is such that even a heavy rainfall will pass therethrough faster than it will collect on the upper surface to form a sheet or puddles of water thereon, leaving the upper surface comparatively dry to prevent or greatly reduce skidding or hydroplaning of vehicle tires thereon. In addition, as pointed out in U.S. Pat. No. 3,690,227, the layer means 49, by its composition, provides an upper surface having a very high coefficient of friction, also preventing or greatly reducing such skidding even when dry, and such layer means has a very high compressive strength adequate to take heavy loads and shocks, such as imposed by heavy vehicles and landing aircraft, without breaking or fracturing. The wide panels 11 and 11*b* are also braced against such loads and shocks by their longitudinal internal ribs 27.

Liquid passing downwardly through the layer means 49 flows through the perforations 36 and 36*a* into the longitudinal channels 28 and 28*a* and therethrough, discharging into the duct 65 of the manifold block 64 through which it is conducted to a point of disposal. Liquid passing into the spaces between adjoining panels 11, 11*a*, and 12 readily passes downwardly therethrough in view of the loose fits therebetween and longitudinally therethrough and also discharges into the duct 65 of the manifold block. The spaced between adjoining panels also, in effect, provide anti-skid grooves, which is another feature of the invention.

The blower means 22 and piping 21 provide means for forcing hot air under pressure into the duct 65 of the manifold block 64, passing longitudinally therethrough, into the longitudinal channels 28 and 28*a* of the panels 11, 11a, and 12, upwardly through the perforations 36 and 36*a* and through the channels in the layer means 49 to heat such layer means and the metal parts of the panels to melt snow and ice on the upper surface of the layer means. Such hot air likewise passes through the spaces between the panels 11, 11*a*, and 12, and upwardly therethrough to heat the panels and any ice or snow therebetween to assist in such melting. Since the metallic parts of the panels 11, 11*a* and 12 are preferably formed of an aluminum alloy which is both light in weight and highly heat conductive, heat is transmitted through the body of the structure 10 as well as through the channels therein to assist in the melting of snow and ice thereon, and this is an important feature of the invention.

It is also to be noted that hot air so forced through the structure 10 to the upper surface thereof may be simultaneous with the passage of liquid, such as water from melted snow or ice, downwardly therethrough and countercurrent thereto, and this is another important feature of the invention as it permits the structure 10 to be heated continuously and concurrently with the melting of ice and snow on the structure and the disposal of melt therefrom. Of course, the blower means 22 is ordinarily operated only when it is desired to melt snow or ice from the upper surface of the structure 10. It is to be understood, although not shown, that the duct 65 of the manifold block 64 is closed at its ends to pressurize the duct when the blower means 22 is operated, to maintain hot air pressure sufficient to force such air through the structure 10 and to its upper surface and countercurrent to the flow of water therethrough as described above.

Although the preferred embodiment described hereinabove has been described as the use of the frictional self-draining structure 10 as an airport runway, it will be understood that such structure is also well adapted for use as a landing deck for use on an aircraft carrier, the surface of a racetrack, or other vehicular surfaces where the collection of liquid on the exposed surfaces thereof is or might be detrimental to their uses.

It also will be understood that the panels 11, 11*a* and 12 may be prefabricated economically away from the point of their intended use, readily transmitted to such point, and laid by unskilled labor to form such a self-draining structure 10, all of which are important objects and advantages of the invention.

I do not intend to be limited to the specific details of the invention disclosed herein as a preferred embodiment, but desire to be afforded the full scope of the following claims.

I claim:

1. A frictional self-draining structure for a supporting surface, including:

a plurality of individual panels, laid end to end and side by side to form a relatively flat and continuous upper surface, each of said panels including an upper surface to which is rigidly attached layer means of structurally rigid porous aggregate having an exposed surface providing a high coefficient of friction and providing a multiplicity of open channels therethrough adapted to permit fluids to pass through said layer, each of said panels having longitudinal channel means therein below said layer and communicating with said open channels through perforations formed in the top of the panel, each of said channel means communicating at least one end with similar channel means in an adjacent panel;

and interlocking means detachably interlocking adjacent panels together against substantial relative movement longitudinally and transversely.

2. A structure as defined in claim 1, including tie-down means for retaining said structure in place on a supporting surface.

3. A structure as defined in claim 1, in which said longitudinal channels communicate with drain means for liquid collecting in said longitudinal channels.

4. A prefabricated panel for use in forming a supporting surface, including:

an extruded integral metallic body portion including, a base plate, rectangular in plan, a top plate parallel to and spaced from said base plate and having a plurality of perforations therethrough, a pair of spaced side plates along the outer edges of said base and top plates and connecting the same, each of said side plates having connecting means on its outer surface adapted to be removably interlocked with a connecting means on an adjacent panel, each of said side plates having a side plate rim projecting above said top plate, said plates forming a longitudinal channel through the panel;

an end plate disposed at each end of said body portion and rigidly attached perpendicular thereto, and having slot means for receiving a key, said end plate having an opening therethrough below said slot means and communicating with said longitudinal channel, each of said end plates having an end plate rim projecting above said top plate; and a layer of structurally rigid porous aggregate attached to the outer surface of said top plate, between and having substantially the same thickness as the distance which said rims project above said top plate, said layer providing a multiplicity of open channels therethrough, at least some of which communicate with said perforations, said open channels being adapted to permit fluid to pass through said layer and said perforations to and from said longitudinal channel.

5. A panel as defined in claim 4, in which said body portion includes a plurality of longitudinal ribs between and parallel to said side plates and spaced therefrom and from each other to form a plurality of said longitudinal channels.

6. A panel as defined in claim 5, in which each of said ribs has a notch in each end receiving a slot means of the adjacent end plate.

7. A panel as defined in claim 5, including tie-down means for attaching said panel to a supporting surface.

8. A panel as defined in claim 4, in which one of said connecting means comprises a pair of longitudinally extending spaced parallel downwardly projecting dogs, and in which the other said connecting means comprises a pair of longitudinally extending spaced parallel upwardly projecting dogs.

9. A panel as defined in claim 7, in which each of said connecting means comprises a pair of longitudinally extending spaced parallel downwardly projecting dogs.

* * * * *